US012258836B2

(12) United States Patent
Shearer et al.

(10) Patent No.: US 12,258,836 B2
(45) Date of Patent: Mar. 25, 2025

(54) METHODS AND SYSTEMS FOR A TOOL TO FORM A FLUID SEAL FOR WIRELINE DIRECTLY BELOW A PACKOFF

(71) Applicant: Greenwell Engineering LLC, Weatherford, TX (US)

(72) Inventors: Gary Shearer, Flint, TX (US); Chris Reed, Canton, TX (US)

(73) Assignee: Greenwell Engineering, LLC, Weatherford, TX (US)

( * ) Notice: Subject to any disclaimer, the term of this patent is extended or adjusted under 35 U.S.C. 154(b) by 0 days.

(21) Appl. No.: 18/432,183

(22) Filed: Feb. 5, 2024

(65) Prior Publication Data

US 2024/0263536 A1 Aug. 8, 2024

Related U.S. Application Data

(60) Provisional application No. 63/443,409, filed on Feb. 5, 2023.

(51) Int. Cl.
*E21B 33/072* (2006.01)
*E21B 33/128* (2006.01)

(52) U.S. Cl.
CPC ..... *E21B 33/072* (2013.01); *E21B 33/1285* (2013.01)

(58) Field of Classification Search
CPC ..... E21B 33/072; E21B 33/1285
See application file for complete search history.

(56) References Cited

U.S. PATENT DOCUMENTS 3,145,995 A * 8/1964 Adamson ..... E21B 33/072 277/330
3,212,581 A * 10/1965 Marshall ..... E21B 33/072 277/330
4,674,328 A * 6/1987 Ward ..... E21B 49/087 73/152.55
4,718,487 A * 1/1988 Lanmon, II ..... F16J 15/3272 277/330
4,899,816 A * 2/1990 Mine ..... E21B 33/08 166/85.5
5,485,745 A * 1/1996 Rademaker ..... E21B 47/135 385/94
5,892,176 A * 4/1999 Findlay ..... E21B 17/206 174/102 R
6,202,764 B1 * 3/2001 Ables ..... E21B 19/22 175/162
6,588,502 B2 * 7/2003 Nice ..... E21B 33/076 277/330
7,434,617 B2 * 10/2008 Artherholt ..... E21B 33/126 277/342
8,387,710 B2 * 3/2013 George ..... E21B 34/08 137/87.06
8,863,830 B2 * 10/2014 Varkey ..... E21B 33/068 166/77.1
8,899,338 B2 * 12/2014 Elsayed ..... E21B 33/085 166/85.4
9,464,496 B2 * 10/2016 O'Rourke ..... E21B 31/20
10,487,616 B2 * 11/2019 Varkey ..... E21B 33/1285
11,293,562 B2 * 4/2022 Mess ..... F16K 37/005
(Continued)

*Primary Examiner* — Aaron L Lembo

(57) ABSTRACT

A tool that allows viscous fluid to be injected into a flow tube to form a fluid seal around the wireline, and allow the fluid to be removed from the tool below a packoff in order to isolate well pressure from packoff rubbers.

20 Claims, 3 Drawing Sheets

(56) References Cited

U.S. PATENT DOCUMENTS

| | | | | |
|---|---|---|---|---|
| 11,428,063 | B1 * | 8/2022 | Strankman | E21B 33/072 |
| 11,965,392 | B2 * | 4/2024 | Ferguson | E21B 33/1285 |
| 2008/0110613 | A1 * | 5/2008 | Holte | E21B 33/072<br>166/84.2 |
| 2009/0277627 | A1 * | 11/2009 | Dallas | E21B 33/068<br>166/85.1 |
| 2021/0062589 | A1 * | 3/2021 | Kennedy | E21B 17/023 |
| 2023/0084887 | A1 * | 3/2023 | McCorry | E21B 19/08<br>277/336 |

* cited by examiner

METHODS AND SYSTEMS FOR A TOOL TO FORM A FLUID SEAL FOR WIRELINE DIRECTLY BELOW A PACKOFF

BACKGROUND INFORMATION

Field of the Disclosure

Examples of the present disclosure relate to systems and methods associated with wireline pump-down tools. More specifically, embodiments are directed towards a tool that allows viscous fluid to be injected into a flow tube to form a fluid seal around the wireline and allow the fluid to be removed from the tool below a packoff to isolate well pressure from packoff rubbers.

BACKGROUND

In the oil and gas industry, the term wireline broadly defines industry-specific methods, processes, and technologies that lower cables and wires into a wellbore. The wirelines are strong, thin wire or braided cable mounted on a power reel. Wireline activities are vital for oilfield operations and are essential to oil and gas exploration.

Coated line cables are generally fed through a packoff, which includes multiple rubber elements. The packoff utilizes well pressure to radially expand the rubber elements, which creates a seal around the coated line cable. The seal created around the coated line cable has a very high compression rate that causes massive friction against the outer diameter of the coated line cable within the packoff. The higher the pressure around the wireline, the more susceptible the coated line cable is to damage and failure rate. To this end, when using coated line cables, a major point of failure is at the packoff due to the constriction around the packoff rubbers without sufficient weight or tension on the wireline. When situations arise where it would be desirable to mitigate the constriction caused by the packoff, it is necessary to isolate the well pressure below the packoff, such that the packoff rubbers are not in compression around the wireline at lower tension.

Accordingly, needs exist for systems and methods configured to be directly coupled to a distal end of a wireline packoff. In embodiments, the tool may include a flow tube, injection valve, and return valve, wherein the injection valve is configured to continually inject sealing fluid into the flow tube that replaces fluid within the flow tube to maintain a seal between the flow tubes and the outer diameter of the coated wireline cable when the coated wireline cable moves through the flow tubes, which bridges the gap between surface weight and required weight for downhole weight.

SUMMARY

Embodiments disclosed herein describe systems and methods for a tool. The tool is configured to be directly coupled to a distal end of a wireline packoff. The tool diverts pressure away from the distal end of the wireline packoff by forming a fluid seal between the wireline and brass flow tubes encased in a metal tube. This reduces or eliminates line pressure and/or friction caused by deployed rubber elements around the wireline while the wireline is being run in a hole. Specifically, while the wireline is moving through the flow tubes and the packoff, grease or heavy oil may be injected into an injection valve positioned at a distal end of the tool, the fluid may travel through the brass flow tubes in an annulus between an outer diameter of the wireline and an inner diameter of the brass flow tubes forming a seal, and the fluid may exit the system through a return valve at a proximal end of the tool above the brass flow tubes. Embodiments of the tool may include a proximal end, a distal end, a first tube, a flow tube, an injection valve, a return valve, and at least one collar.

The proximal end of the tool may be configured to be directly coupled to a distal end of the packoff. In embodiments, an outer diameter of the proximal end may include threads or other types of coupling mechanisms, which may allow the packoff to be run downhole with the tool from the surface. An inner diameter of the proximal end may also include threads or other coupling mechanisms that are configured to directly couple the first tube and the flow tubes with the proximal end. In embodiments, the proximal end may be positioned between the first tube and the packoff.

The distal end of the tool may be configured to be coupled with a lubricator or another type of tool downhole. An inner diameter of the distal end may include threads or other coupling mechanisms that are configured to directly couple the first tube and the flow tubes with the proximal end. In embodiments, the distal end of the tool may be positioned between the first tube and the downhole lubricator.

The first tube may be a metal tube that extends from the proximal end to the distal ends. The first tube may have an outer diameter that is smaller than the outer diameters of the proximal end and/or the distal end. In embodiments, the first tube may be formed of a first type of metal.

The flow tube may be a brass flow tube that is encased within the first tube, wherein the brass is softer than the first type of metal. The length of the flow tube may be longer than that of the first tube, and an outer diameter of the flow tube may be positioned within the inner diameter of the first tube. An upper face of the flow tube may be configured to interface with the return valve and a lower face of the flow tube may be configured to interface with the injection valve. In embodiments, the coated wireline may be configured to be positioned through the flow tube, and a fluid seal may be formed in an annulus between the outer diameter of the coated wireline and the inner diameter of the flow tube. In embodiments, the flow tube may have additional ports that are configured to align with the ports of the collars. These ports may be sealed, or used as injection ports or return ports.

The injection valve may be configured to inject sealing fluid, such as wireline grease or heavy oil, into the lower face of the flow tube. In embodiments, the injection valve may be positioned below the flow tube to maximize the surface area of the liquid seal within the flow tube. Furthermore, by positioning the injection valve below the flow tube, an entirety of the annulus between the flow tube and the wireline may be utilized for the fluid seal. The injection valve may be configured to inject the sealing fluid into the flow tube to replace fluid caused by the tool running downhole. To this end, the injection valve may inject fluid into the flow tube at a pressure that is higher than the well pressure, wherein the well pressure may cause the fluid to flow uphole towards the return valve.

The return valve may be configured to receive fluid from the upper face of the flow tube and remove fluid causing the liquid seal within the flow tube. By removing the fluid between the flow tube and the wireline packoff, the wireline packoff may be isolated from well pressure. The isolation of pressure may minimize friction created between the rubber elements of the wireline packoff and the outer diameter of the coated wireline. To this end, the rubber elements of the packoff may not be radially expanded, which may not cause a seal between the inner diameter of the rubber elements of the packoff and the outer diameter of the wireline while fluid is being injected and removed from the tool.

The collars may be configured to be coupled to an outer diameter of the first tube and the flow tube. The collars may include ports that are configured to be aligned within secondary ports within the first tube and the flow tube. The ports on the collar and the secondary ports may be configured to be sealed, receive sealing fluid, or act as secondary or tertiary return lines.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
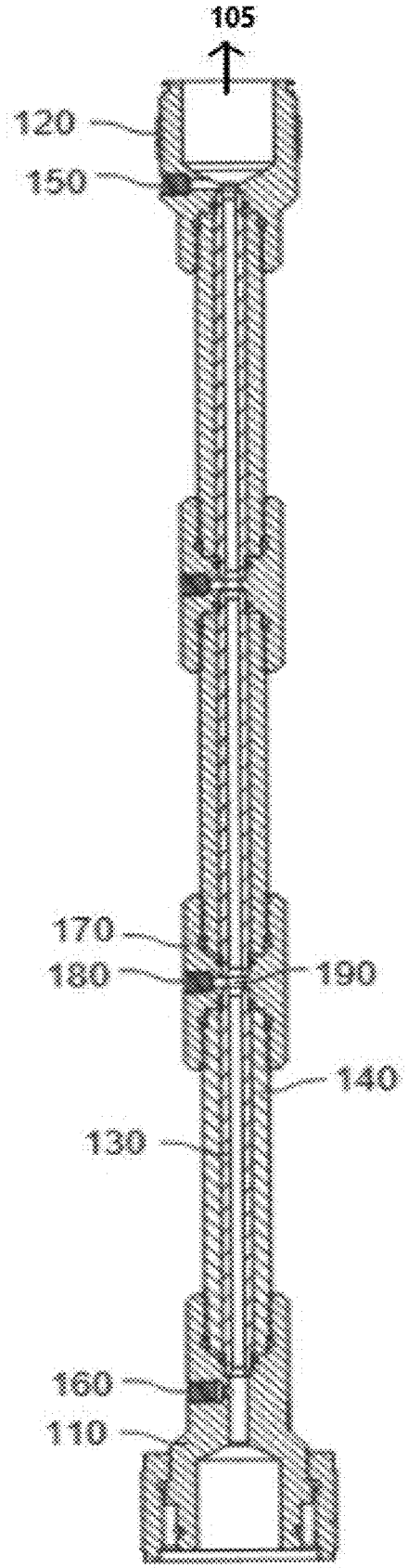
FIG. 1 depicts a tool configured to reduce friction on wireline being positioned within a well, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts tool 100 configured to reduce friction on wireline being positioned within a well, according to an embodiment. The reduction of friction may be caused by reducing downhole pressure on a packoff 105, which may allow the rubber elements of packoff 105 to not be radially expanded. Tool 100 may include a proximal end 110, distal end 120, first tube 130, flow tube 140, injection valve 150, return valve 160, and at least one collar 170.

Proximal end 110 of the tool 105 may be configured to be coupled to a distal end of the packoff 105. In embodiments, the proximal end 110 may include threads or other types of coupling mechanisms, which may allow the packoff 105 to be run downhole along with tool 100. The proximal end 110 may also include threads or other coupling mechanisms positioned on its inner diameter that are configured to directly couple with threads positioned on the outer diameter of the first tube 130 and the flow tube 140. In embodiments, the proximal end 110 may be positioned between the first tube 140 and the packoff 105.

Distal end 120 of the tool 100 may be configured to be coupled with a lubricator or another type of tool downhole. In embodiments, distal end 120 may be a bowing connector. Distal end 120 may also include threads or other coupling mechanisms on its inner diameter that are configured to directly couple with threads positioned on the outer diameters of the first tube 130 and the flow tube 140. In embodiments, distal end 120 may be positioned between the first tube 130 and the downhole lubricator.

First tube 130 may be a metal, such as steel, tube that extends from the proximal end 110 to the distal end 120. First tube 130 may have an outer diameter that is smaller than the outer diameters of the proximal end 110 and/or the distal end 230.

Flow tube 140 may be a brass flow tube that is encased within the first tube 130, wherein flow tube 140 is formed of a softer metal than first tube 130. The length of flow tube 140 may be longer than that of the first tube 130, and an outer diameter of flow tube 140 may be positioned within the inner diameter of the first tube 130. An upper face of the flow tube 140 may be configured to interface with the return valve 160, and a lower face of the flow tube 140 may be configured to interface with the injection valve 150. The upper face and lower face of flow tube 140 may include a tapered inner diameter, which may assist in allowing the wireline cable to be inserted into the inner diameter of flow tube 140. In embodiments, the coated wireline may be configured to be positioned through flow tube 140, and a fluid seal may be formed in an annulus between the outer diameter of the coated wireline and the inner diameter of flow tube 140. The annulus may be around three one-thousands of an inch, and the length of flow tube 140 may be approximately three feet in length. In embodiments, the flow tube 140 may have additional ports 190 that are configured to align with port 180 of the collars 170. These ports 190 may be sealed, or used as additional injection ports or return ports.

Injection valve 150 may be configured to inject sealing fluid, such as wireline grease or heavy oil, into the lower face of flow tube 140 at a desired pressure. Injection valve 150 may be positioned below the packoff 105. The fluid injected into injection valve 150 may travel upwards through flow tube 140 based on the well pressure, causing a dynamic liquid seal in an annulus/clearance between the wireline and the inner diameter of flow tube 140. In embodiments, injection valve 150 may be positioned below the flow tube 140, at a connector to the lubricator, to maximize the surface area of the liquid seal within the flow tube 140 while potentially only needing a single injection valve 150. Injection valve 150 may be configured to receive and inject sealing fluid into flow tube 140 to replace fluid caused by the wireline being run downhole within tool 100. Once tool 100 is at a desired depth, such as 10,000 feet, where there is sufficient wireline weight, injection valve 150 may cease to inject fluid into flow tube 140, and packoff 105 may operate normally due to the tension caused by the wireline weight. Specifically, in embodiments, injection valve 150 may inject fluid into the annulus between the wireline and flow tube 140 to match a well pressure, such as 5000 psi. In embodiments, sensors may be positioned at injection valve 150 and/or return valve 160 to continuously determine the downhole well pressure.

This may continue until the wireline reaches a desired depth with sufficient weight to cause tension on the wireline. Responsive to ceasing the injection of the fluid, the packoff 105 may be exposed to downhole pressure causing the rubber elements to radially expand and constrict around the wireline. In further embodiments, injection valve 150 may receive and inject fluid into the annulus at a greater pressure than the well pressure to create a fluid seal, such as 500 psi more than the well pressure and/or the readings taken by the sensors at injection valve 150 and/or return valve.

Return valve 160 may be configured to receive fluid from the upper face of the flow tube 140 and remove fluid causing the liquid seal within flow tube 140. Return valve 160 may be positioned below the packoff 105, which will remove the well pressure below tool 100 that is conventionally applied to packoff 105. By removing the fluid between flow tube 140 and the wireline packoff 105, the wireline packoff 105 may be relieved from additional well pressure, which may minimize friction created between the rubber elements of the wireline packoff 105 and the outer diameter of the coated wireline. Specifically, isolating the well pressure below packoff 105 from packoff 105 will not allow the rubber elements of the packoff 105 to deploy. This allows the wireline to be run downhole tool at faster speeds with more tension while minimizing tool weight.

Excess fluid injected into the system may travel from injection valve 150 based on the fluid being injected from injection valve 150 at a greater pressure than the well pressure, wherein the excess fluid may travel out of return valve 160 through tubing into a waste tank. More specifically, in embodiments, due to the well pressure, the sealing fluid may flow from injection valve 150 upwards, through the annulus between flow tube 140 and the wireline, and out of return valve 160. By removing this excess fluid out of return valve 160, pressure around the packoff 105 may be relieved.

Collars 170 may be configured to be coupled to an outer diameter of the first tube 130 and the flow tube 140. Embodiments may include a plurality of collars 170. Each of the collars 170 may include ports 180 that are configured to be aligned within secondary ports 190 within the first tube 130 and the flow tube 140. Ports 180 and secondary ports 190 may be configured to be sealed, receive sealing fluid, or act as secondary or tertiary return lines. In embodiments, between ports 180 and secondary ports 190 on the flow tube, 140 may include o-ring seals, such as two 300 series O-ring seals. Furthermore, embodiments may include sensors located in the secondary port 190 configured to determine downhole pressure.

Figure 2:
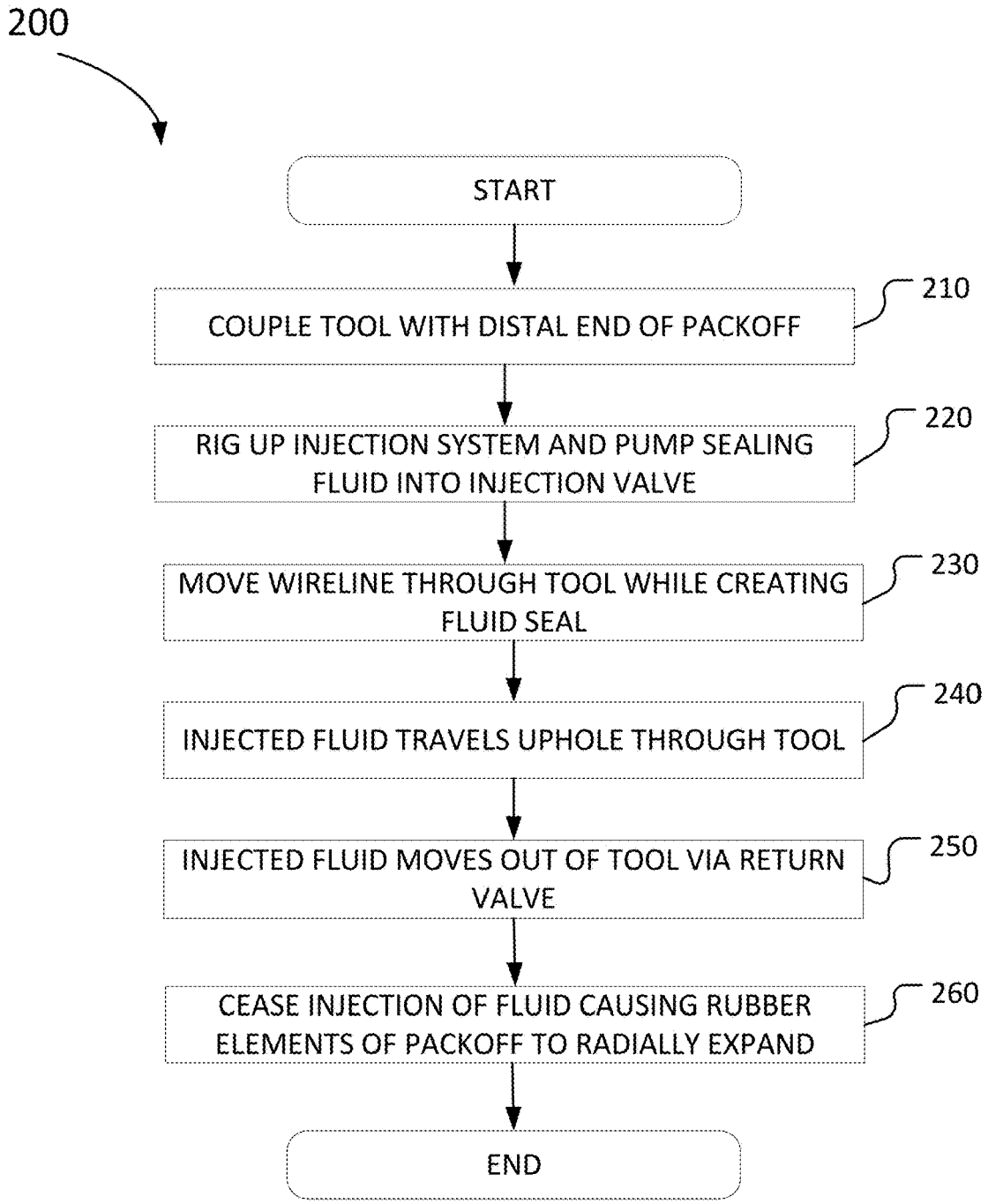
FIG. 2 depicts an operation sequence utilizing a tool positioned below a packoff, according to an embodiment.
Figure 3:
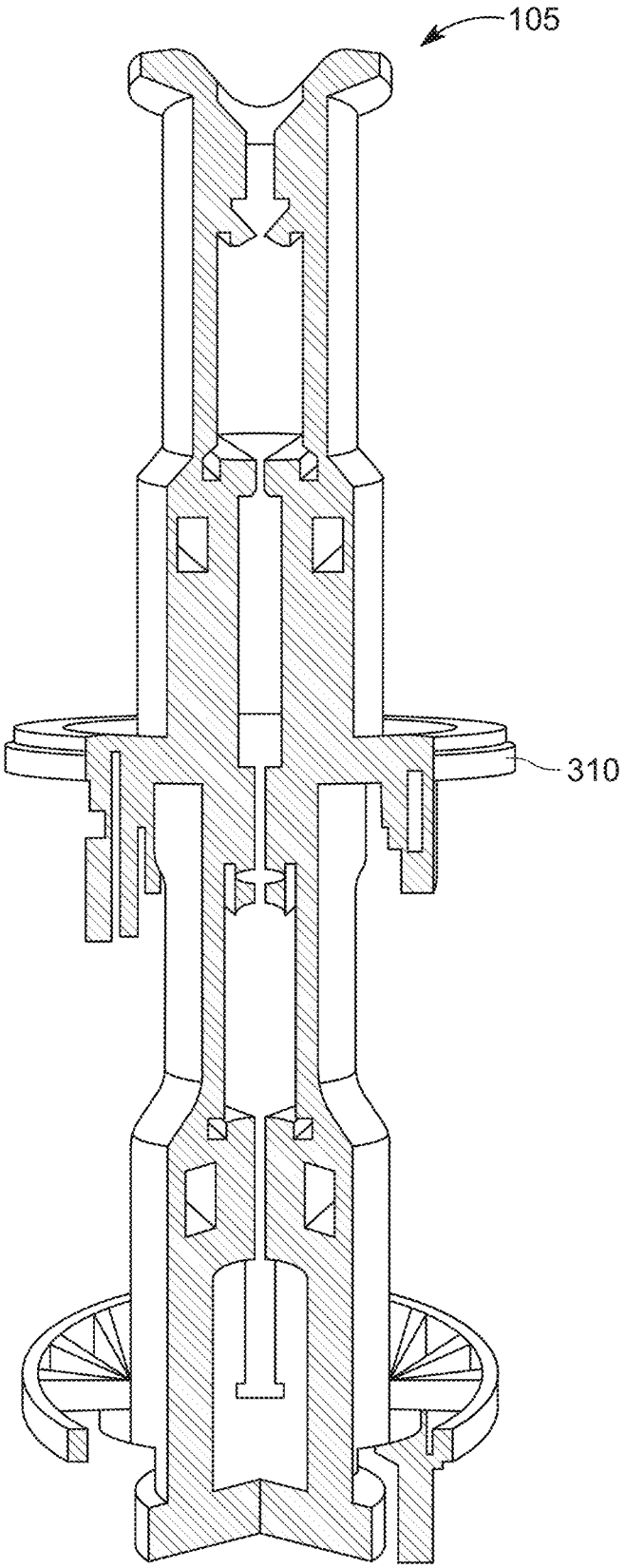
FIG. 3 depicts a packoff, according to an embodiment.

FIG. 2 depicts an operation sequence utilizing a tool positioned below a packoff, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 3 and described below is not intended to be limiting.

At operation 210, a proximal end of the tool may be coupled directly to a distal end of the packoff. In embodiments, the tool may be positioned between the packoff and a lubricator.

At operation 220, an injection system may be initialized to pump sealing fluid into an injection valve, wherein the injection valve is located on a distal (downhole) end of the tool below a distal end of a flow tube.

At operation 230, the wireline may be moved downhole through the packoff and the tool from the surface. While the wireline is moving through the tool, fluid may be injected into an annulus between the outer diameter of the wireline and a flow tube via the injection system and injection valve. In embodiments, the fluid may be injected at a pressure that is greater than a well pressure.

At operation 240, the injected fluid may travel uphole through the annulus between the wireline and the flow tube, while the wireline is moving downhole through the flow tubes. The injected fluid may create a seal within the annulus.

At operation 250, the fluid injected into the tool may pass through the flow tubes and flow out of a return valve, wherein the return valve is positioned above the flow tube and below the packoff.

At operation 260, the wireline may be run to a desired depth, which may be more than 6000-8000 feet downhole. Upon reaching a desired depth, fluid may cease to be injected into the injection valve. This may cause the packoff to operate in a conventional manner, wherein rubber elements may constrict around the wireline. However, due to the weight of the wireline at the desired depth the wireline may be in tension, reducing the chances of the packoff damaging the wireline.

FIG. 3 depicts a packoff 105, according to an embodiment. Packoff 105 may include rubber elements 310. Conventionally rubber elements 310 may radially expand and expand due to well pressure below packoff 105. However, tool 100 is configured to isolate the well pressure below packoff 105 from packoff 105 by forming the fluid seal within the flow tubes. This isolation of pressure may not allow the rubber elements 310 to radially expand until fluid ceases to be injected via the injection valve.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A tool configured to be coupled to a distal end of a packoff, the tool comprising:

a first tube;

a flow tube with an upper face and a lower face, wherein the flow tube is configured to receive a wireline run through the flow tube and an annulus is created between an inner diameter of the flow tube and an outer diameter of the wireline;

an injection valve positioned downhole from the lower face of the flow tube, the injection valve being configured to allow sealing fluid to be injected into the lower face of the flow tube, wherein well pressure causes the sealing fluid to travel up hole within the annulus, wherein the sealing fluid creates a fluid seal between the wireline and the flow tube;

a return valve positioned uphole from the upper face of the flow tube, wherein the return valve is configured to remove the sealing fluid from the tool below the packoff.

2. The tool of claim 1, wherein the injection valve is configured to inject fluid at a pressure greater than the well pressure.

3. The tool of claim 1, further comprising: a first direct connector that is configured to directly couple the tool with a distal end of the packoff, wherein the return valve extends through the first direct connector.

4. The tool of claim 1, wherein the first tube is formed of a first metal, and the flow tube is formed of a second metal, the second metal being a softer metal than the first metal.

5. The tool of claim 1, wherein the flow tube includes a plurality of ports.

6. The tool of claim 5, further comprising: at least one collar with a collar port, each of the collar ports being configured to align with a respective port of the flow tube.

7. The tool of claim 1, wherein the sealing fluid is injected through the injection valve until the tool reaches a desired depth, wherein the desired depth is based on a weight of the wireline downhole.

8. The tool of claim 1, further comprising: a line connecting the return valve to a waste tank.

9. The tool of claim 1, wherein the tool is configured to isolate packoff from the well pressure while sealing fluid is being injected into the flow tube via the injection valve.

10. The tool of claim 1, wherein the sealing fluid injected into the flow tube via the injection valve travels from the lower face to the upper face.

11. A method for creating a fluid seal comprising:

positioning a flow tube within a first tube, wherein a lower face of the flow tube is positioned below a distal end of the first tube, and an upper face of the flow tube is positioned above a proximal end of the first tube;

running wireline within the flow tube;

creating annulus is between an inner diameter of the flow tube and an outer diameter of the wireline;

injecting sealing fluid through an injection valve positioned downhole from the lower face of the flow tube, wherein well pressure causes the sealing fluid to travel up hole within the annulus;

forming a fluid seal between the wireline and the flow tube via the sealing fluid;

removing the sealing fluid from the flow tube via a return valve positioned uphole from the upper face of the flow tube below the packoff.

12. The method of claim 11, wherein the sealing fluid is injected into the injection valve at a pressure greater than the well pressure.

13. The method of claim 11, further comprising: directly coupling a first direct connector of the tool with a distal end of packoff, wherein the return valve extends through the first direct connector.

14. The method of claim 11, wherein the first tube is formed of a first metal, and the flow tube is formed of a second metal, the second metal being a softer metal than the first metal.

15. The method of claim 11, wherein the flow tube includes a plurality of secondary ports.

16. The method of claim 15, further comprising: at least one collar with a collar port, each of the collar ports being configured to align with a respective secondary port.

17. The method of claim 11, further coming: injecting the sealing fluid through the injection valve until the tool reaches a desired depth, wherein the desired depth is based on a weight of the wireline downhole.

18. The method of claim 11, further comprising: connecting a line from the return valve to a waste tank.

19. The method of claim 11, further coming: isolating a packoff from the well pressure while the sealing fluid is being injected into the flow tube via the injection valve.

20. The method of claim 11, wherein the sealing fluid injected into the flow tube via the injection valve travels from the lower face to the upper face.

* * * * *